US005742032A

United States Patent [19]

Eke

[11] Patent Number: 5,742,032

[45] Date of Patent: Apr. 21, 1998

[54] MICROWAVE OVEN WITH TRANSFORMER HAVING RESISTIVE HEATING IN SERIES WITH THE PRIMARY WINDING

[75] Inventor: Kenneth Ian Eke, Orlando, Fla.

[73] Assignee: Microwave Ovens Limited, Shirley, England

[21] Appl. No.: 750,511

[22] PCT Filed: May 10, 1995

[86] PCT No.: PCT/GB95/00984

§ 371 Date: Mar. 3, 1997

§ 102(e) Date: Mar. 3, 1997

[87] PCT Pub. No.: WO95/34191

PCT Pub. Date: Dec. 14, 1995

[30] Foreign Application Priority Data

Jun. 7, 1994 [GB] United Kingdom ..... 9411309

[51] Int. Cl.[6] ..... H05B 6/68

[52] U.S. Cl. ..... 219/681; 219/685; 219/715; 219/721; 219/757

[58] Field of Search ..... 219/681, 682, 219/683, 684, 685, 710, 715, 716, 718, 721, 757

[56] References Cited

U.S. PATENT DOCUMENTS

| | | | |
|---|---|---|---|
| 4,198,553 | 4/1980 | Dills | 219/685 |
| 4,337,384 | 6/1982 | Tanaka et al. | 219/681 |
| 4,369,347 | 1/1983 | Shin | 219/757 |
| 4,647,746 | 3/1987 | Eke | 219/681 |
| 4,798,927 | 1/1989 | Kaminaka | 219/685 |

FOREIGN PATENT DOCUMENTS

| | | | |
|---|---|---|---|
| 2-257589 | 10/1990 | Japan | 219/685 |

*Primary Examiner*—Philip H. Leung
*Attorney, Agent, or Firm*—Lee, Mann, Smith McWilliams, Sweeney & Ohlson

[57] ABSTRACT

A microwave oven has a food-receiving cavity and a magnetron for delivering microwave power to the cavity. The magnetron is supplied with a high voltage through a transformer, and a variable impedance is connected in series with the primary winding of the transformer. The resistive heating effect produced by primary current is utilized to heat the air in the oven cavity, and the magnitude of the impedance is variable to vary the output of the magnetron.

8 Claims, 5 Drawing Sheets

Figure 1:
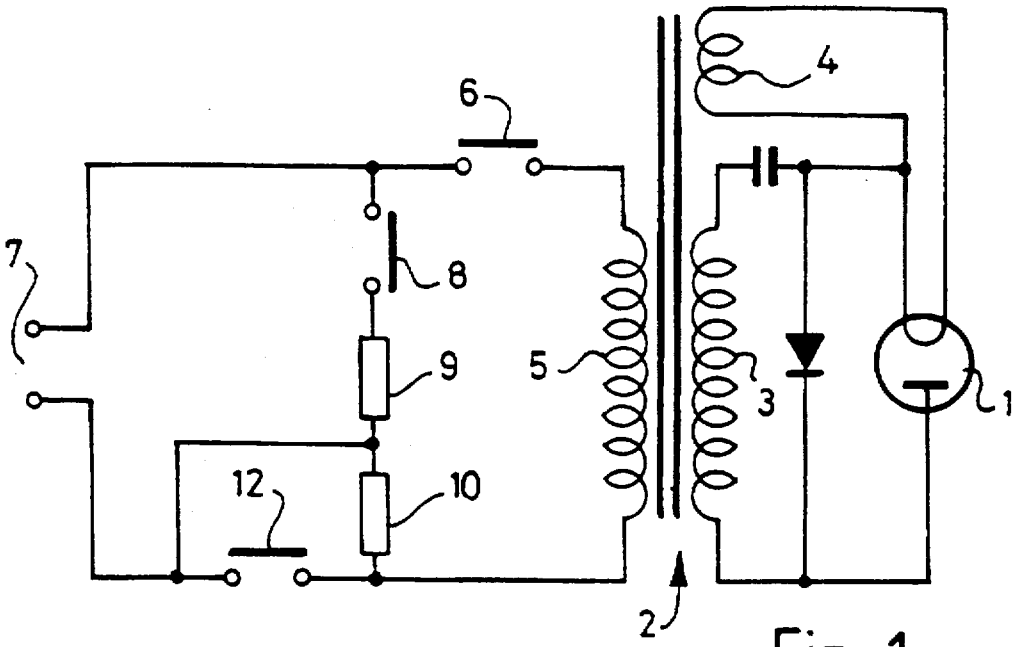

MICROWAVE OVEN WITH TRANSFORMER HAVING RESISTIVE HEATING IN SERIES WITH THE PRIMARY WINDING

This invention relates to microwave ovens.

According to one aspect of the invention there is provided a microwave oven having a cavity to receive food to be cooked, a magnetron for delivering microwave power to the cavity, a transformer for supplying the magnetron with the necessary high voltage, the transformer having a primary winding, characterised in that a resistance is connected in series with the primary winding, the resistive heating produced by primary current flowing through the resistance being utilised to heat the air in the cavity.

Said resistance is preferably provided by an impedance having a reactive component (mainly inductive) in addition to the resistive component. The resistive heating may be introduced to the cavity as a forced flow of air which is blown over the impedance by a fan. The impedance may be positioned adjacent an aperture in a rear wall of the cavity, the fan drawing air from the cavity, through the aperture, over the impedance and then recirculating the heated air into the cavity through apertures in the rear wall of the cavity.

The fan may serve to cool the magnetron, in which case the air is heated by being blown over the magnetron and then further heated by being blown over the impedance, before being forced into the oven cavity.

The oven may have a temperature sensing device (eg a thermistor) for sensing the temperature of the air and the temperature sensing device may be located in the region where the air leaves the oven cavity. The variation of detected temperature with time will be characteristic of the thermal load of a food item being cooked in the cavity, leading to the possibility of achieving automatic control of the cooking process by the use of a microprocessor which senses the variation of the hot air temperature with time.

The oven may have, in addition to the impedance, a main resistive heating element over which air is drawn, and in this case the resistive heating produced by the air forced over the impedance can supplement the heating produced by the air forced over the main heating element.

The magnitude of the resistance may be adjustable so as to vary the magnitude of the primary current and, in turn, the power produced by the magnetron. By utilising this feature, the microwave power delivered to the cavity can be readily controlled.

According to another aspect of the invention there is provided a microwave oven having a cavity to receive food items to be cooked, a magnetron for delivering microwave power to the cavity, a transformer for delivering electrical power to the magnetron, an electrical resistance heating element and a fan for forcing hot air through the cavity, wherein the transformer has a primary winding and an electrical resistance is connected in series with the winding so that primary current in the electrical resistance produces a resistive heating effect which is added to the heat introduced into the cavity by the hot air flow.

According to a further aspect of the invention there is provided a microwave oven having a cavity to receive food to be cooked, a magnetron for delivering microwave power to the cavity, a transformer for supplying the magnetron with the necessary high voltage, the transformer having a primary winding, characterised in that a resistance is connected in series with the primary winding, the magnitude of the resistance being variable to vary the microwave power produced by the magnetron.

Figure 2:
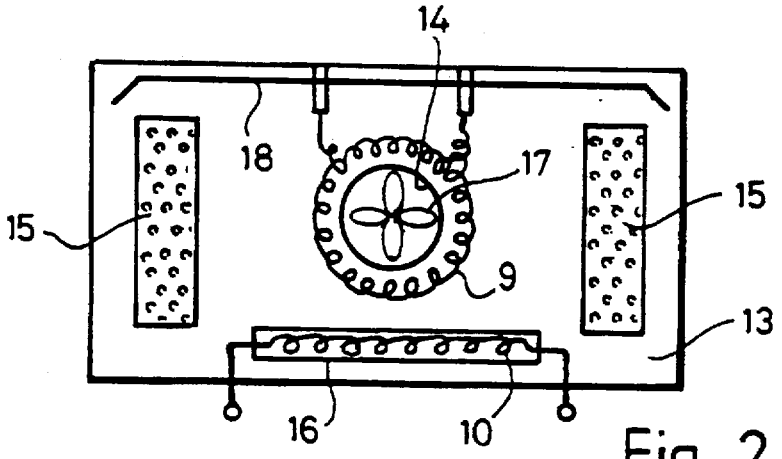
Figure 3:
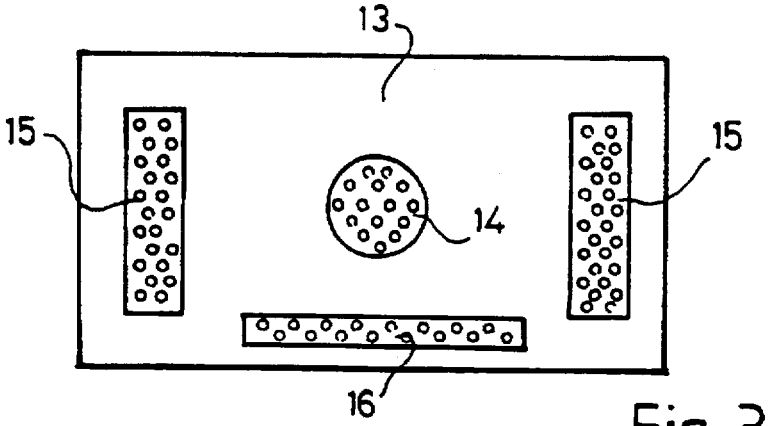
Figure 4:
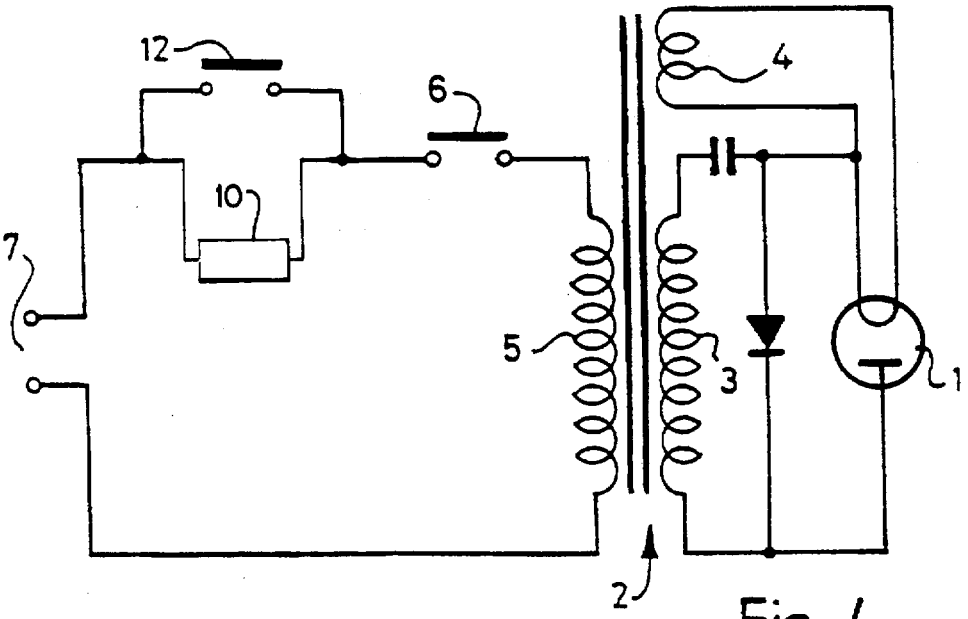
Figure 5:
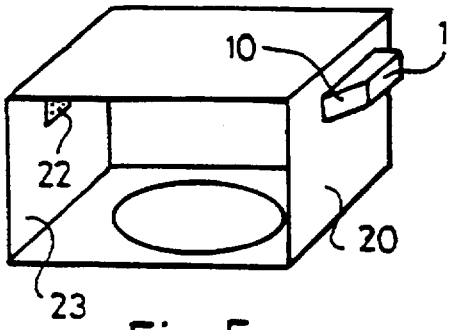
Figure 6:
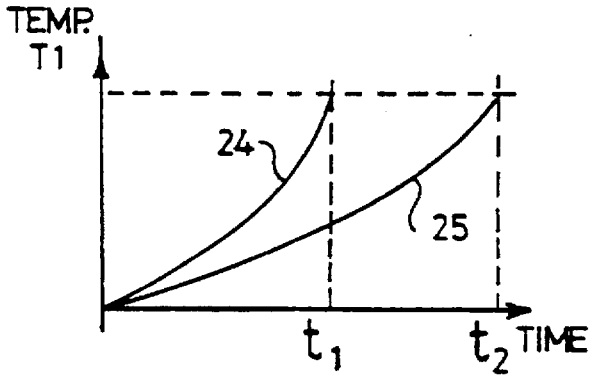
Figure 7:
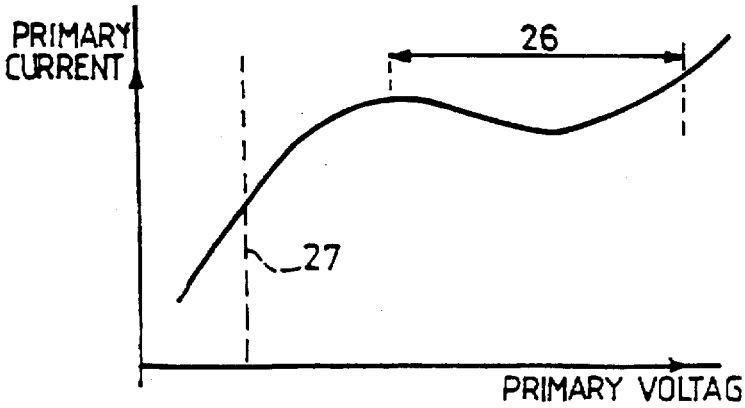

The invention will now be further described, by way of example, with reference to the accompanying drawings, in which:

FIG. 1 is a circuit diagram of a first embodiment of the microwave oven according to the invention, FIG. 2 is a rear view of the oven of FIG. 1, FIG. 3 shows a rear wall of the oven of FIG. 2, viewed from inside the oven cavity, FIG. 4 is a circuit diagram of a second embodiment of microwave oven according to the invention, FIG. 5 is a schematic perspective view showing the structure of the oven of FIG. 4, FIG. 6 is a graph for explaining the operation of the oven of FIGS. 4 and 5, FIG. 7 is a graph for explaining the circuit diagrams of FIGS. 1 and 4.

Figure 8:
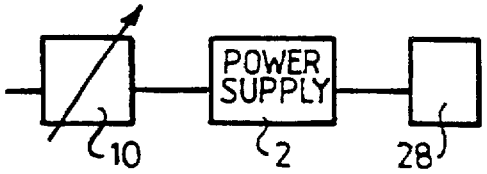
Figure 10:
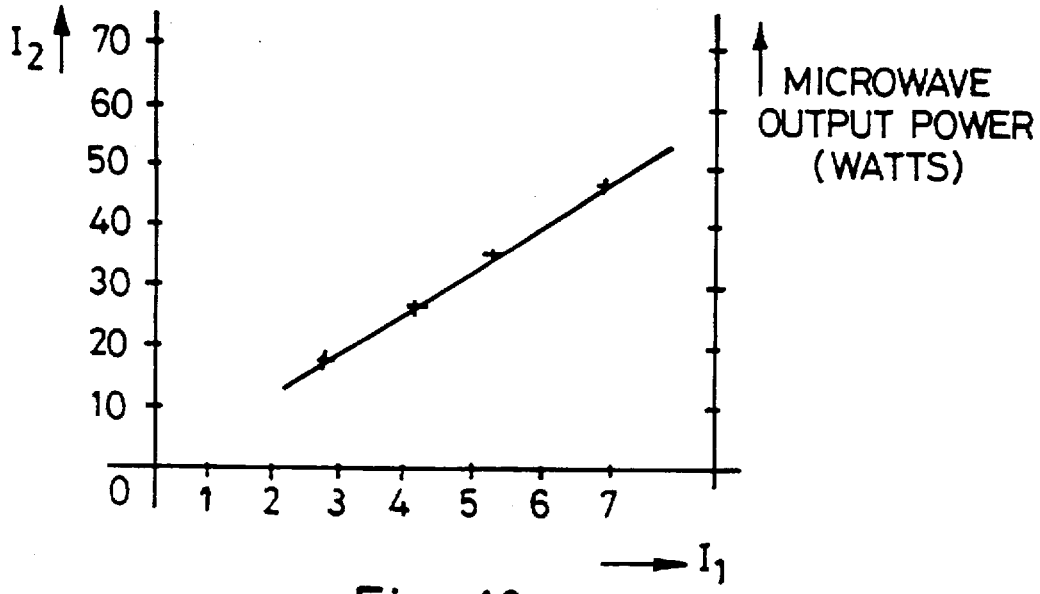
Figure 9:
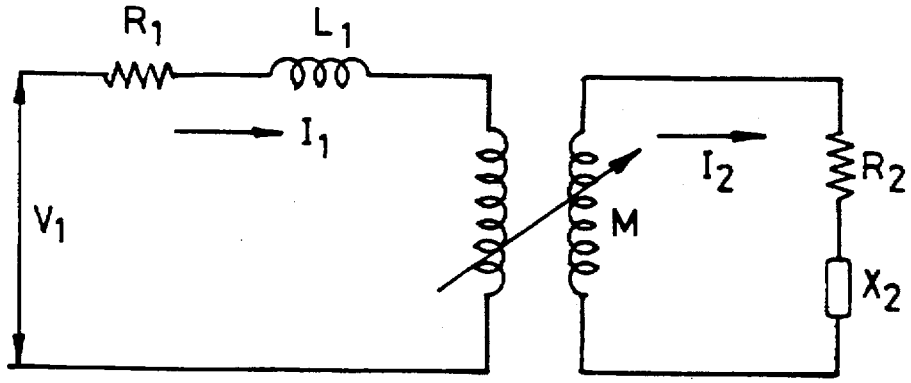
Figure 11:
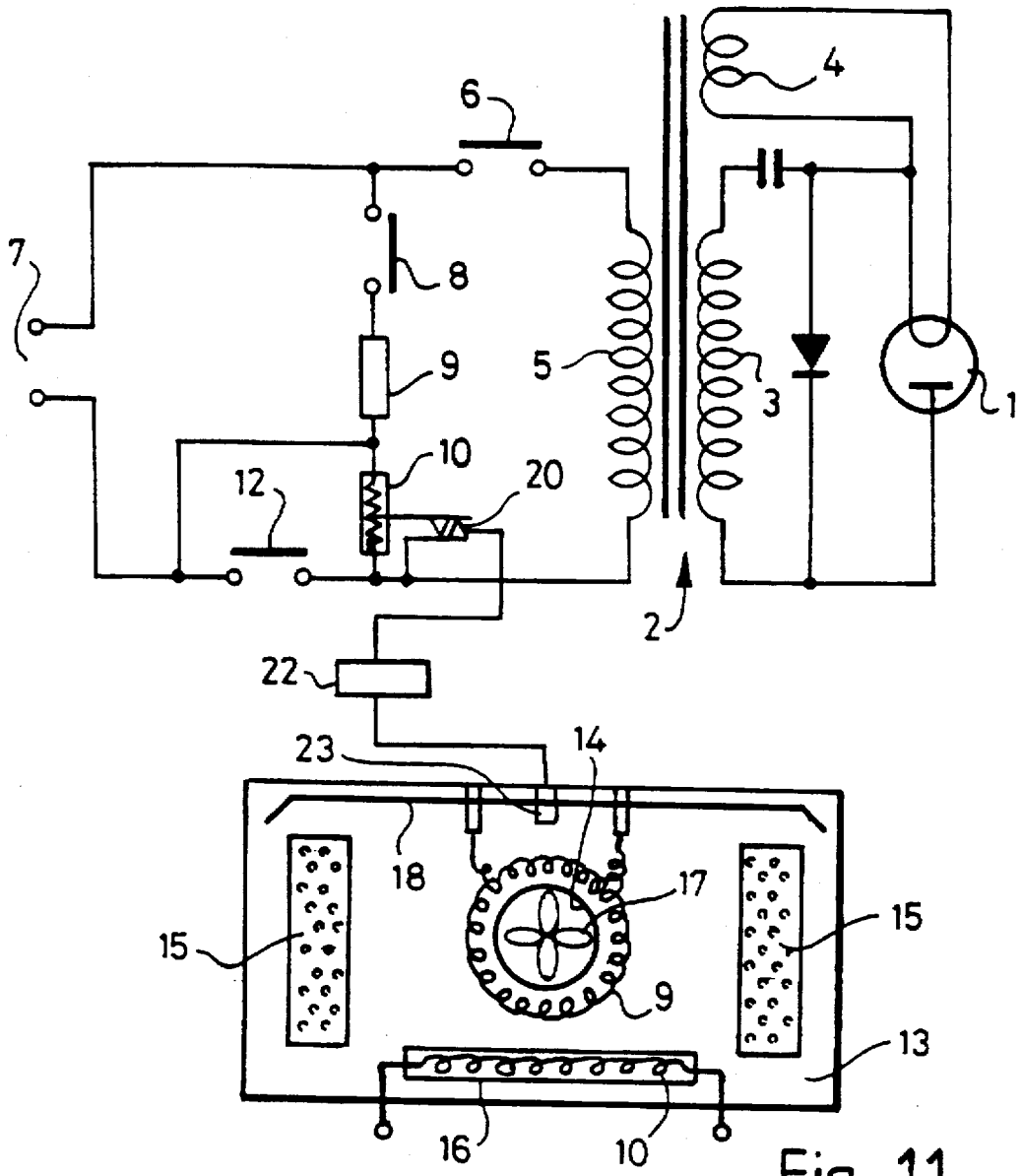
Figure 12:
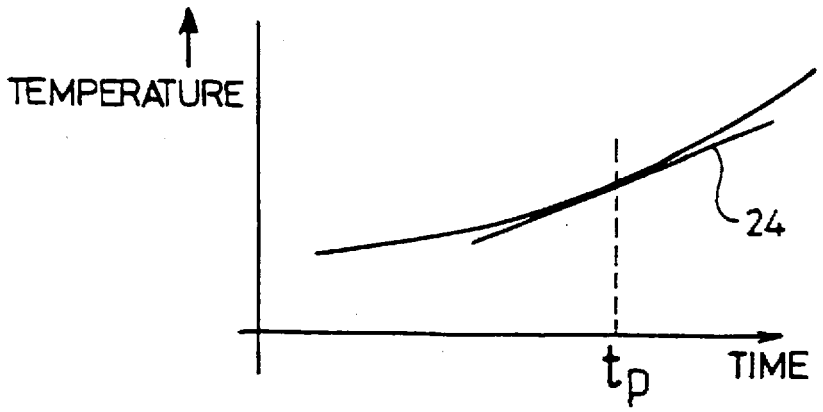
Figure 13:
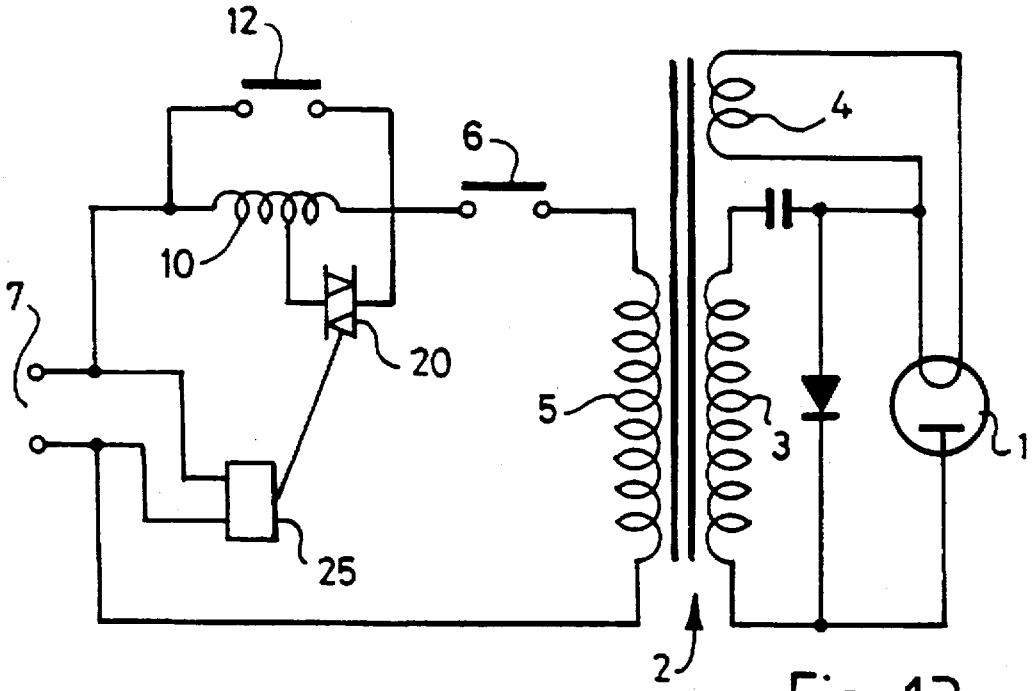

FIG. 8 is a block circuit diagram illustrating how the invention can be used to vary the output power of the magnetron of an oven according to the invention, FIG. 9 is an equivalent circuit diagram (simplified) of the microwave oven, FIG. 10 is a graph illustrating the operation of the microwave oven, FIG. 11 illustrates an oven which represents a modification of the oven of FIGS. 1 to 3, FIG. 12 is a graph illustrating the operation of the oven of FIG. 11, and FIG. 13 illustrates an oven which represents a modification of the oven of FIG. 4.

Referring to FIG. 1, the oven has a magnetron 1 which provides microwave power to a food-receiving cavity of the oven. The magnetron 1 is powered by a transformer 2 having a main secondary winding 3 and a subsidiary secondary winding 4 energising the magnetron filament. The transformer 2 has a primary winding 5 connected, through a "microwave-on" switch 6, across the a.c. mains supply 7.

A "convection-on" switch 8, a main electrical resistance heating element 9 and an impedance 10 are connected in series, and this series array is connected (in parallel with the switch 6 and primary winding 5) across the mains supply 7. A switch 12, connected between one terminal of the mains supply 7 and the common terminal of the clement 9 and impedance 10. enables the impedance 10 to be shorted out.

The impedance 10 has a small reactive component (principally inductive) and also a resistive component, the magnitude of which is set to produce a current or a required magnitude through the transformer primary winding 5 when the impedance 10 is connected in series with the winding 5, i.e. when the switch 12 is open. The impedance 10 is made from nichrome wire coiled to provide the required impedance characteristics, i.e. mainly resistive with a small inductive component.

The structure of the oven is illustrated in FIGS. 2 and 3. The rear wall 13 of the oven cavity has a circular perforated area 14 to draw a forced flow of air from the cavity, two vertically elongated perforated areas 15 for admitting air to the cavity, and a horizontally elongated perforated area 16 which also serves as an inlet for air to the cavity.

FIG. 2 shows the rear of the oven (with a rear cover plate removed) to reveal a convection fan 17, the circular coil of the resistive heating element 9 and a linear coil forming the impedance 10. The fan 17 is positioned immediately behind the perforated area 14, and the impedance 10 is positioned immediately behind the perforated area 16. The fan 17 is operative to draw air from the cavity through the performed area 14 and to force the air into the cavity through the perforated areas 15 and 16, the air being heated by the element 9 and/or the resistive heating component in the impedance 10, depending on whether one or both of these resistances is energised. An air deflector plate 18, in combination with the rear cover plate, facilitates guidance of the air so that the latter is recirculated in a path which draws the air from the cavity through the area 14, re-heats the air by means of the element 9 and/or the impedance 10, and then forces the hot air into the cavity through the areas 15 and 16.

The oven is capable of operating in any one of three modes, namely:

(a) a combination mode in which switch 6 is closed, switch 8 is closed and switch 12 is open, so that microwave energy and forced hot air are delivered to the cavity simultaneously. Electric current flows through the element 9 and the impedance 10, so both provide electrical resistive heating which heats the air forced into the oven cavity by the fan 17. The resistive heating provided by the impedance 10 increases the thermal rating in the combination mode and browns the underside of foods during short cooking times.

(b) a microwave-only mode in which switch 6 is closed, switch 8 is open and switch 12 is closed, so that the magnetron is energised but no current flows through the element 9 or the impedance 10. The fan 17 is not energised and in consequence no forced air flow occurs.

(c) a convection-only mode in which switch 6 is open, switch 8 is closed and switch 12 is closed, so that the magnetron is not energised. Current flows through the element 9 but not through the impedance 10. The fan 17 is energised to force air through the cavity, and this air flow will be heated as a result of passing over the element 9. The impedance 10, being de-energised, does not contribute any heating effect to the forced air flow.

The oven of FIGS. 4 to 6 does not have a resistive heating element 9, as can be seen from the circuit diagram of FIG. 4 where parts corresponding to those of FIG. 1 have been given the same reference numerals. Referring to FIG. 5, the oven cavity has a side wall 20 on the external surface of which is mounted the magnetron 1. The magnetron must be cooled, and this is done by means of a cooling fan mounted adjacent the magnetron. In FIG. 5, the air forced over the magnetron by the fan is further heated by being blown over the impedance 10, before being forced into the oven cavity through apertures in the side wall 20. The air leaves the cavity through a series of perforations 22 on the opposite side wall 23 and then passes to atmosphere. The oven may optionally have a rotatable turntable, as illustrated in FIG. 5.

A temperature sensor (such as a thermistor) is positioned in the air flow leaving the cavity, (ie immediately after passing through the perforations 22) in order to detect the temperature of the air leaving the cavity. In practice, the temperature sensor is preferably placed within the exhaust duct (through which the air passes) and on the outside of the cavity. The provision of the temperature sensor enables the cavity to be calibrated under no load and maximum load conditions. This is done by determining the variation of temperature with time for the oven under no load conditions, and deriving a curve 24 (FIG. 6) which records the time t1 taken for the detected temperature to reach a predetermined threshold T1. Similarly, another curve 25 records the variation of temperature with time for the oven under maximum load conditions, and also records the time taken t2 for the detected temperature to reach the predetermined threshold T1. The temperature/time variations depicted by the curves 24, 25 of FIG. 6 are stored in the microprocessor of the oven and are used in an algorithm which is employed to control the microwave oven to provide automatic cooking for a food item of any size or shape.

In this automatic mode the food item to be cooked is first placed in the oven cavity and the magnetron 1 is energised. During this initial cooking stage, the switch 6 is closed and the switch 12 is open. In consequence, current flows through the impedance 10 and this limits the primary current and hence the output of the magnetron 1. Hence, during this initial cooking stage the magnetron is on reduced power and the impedance 10 produces a resistive heating effect which further heats the air blown into the cavity by the fan cooling the magnetron. When the threshold temperature T1 is reached (after a time dependent on the load of the food item), the controlling microprocessor closes the switch 12, which shorts out the impedance 10 and thereby increases the primary current which in turn increases the power produced the magnetron. Hence, in this second phase the magnetron produces full power but the impedance 10 does not contribute any heating effect to the air blown into the cavity by the fan cooling the magnetron. The duration of the second phase of cooking is determined by the microprocessor in dependence on the time taken for the detected temperature to reach the predetermined threshold T1. When the predetermined threshold temperature T1 is reached, the microprocessor initiates the second phase, computes the duration of the second phase and causes a display clock to count down to zero, so that during the second phase the user knows the time remaining to completion of cooking at the end of the second phase, when switch 6 is opened to de-energise the magnetron.

The impedance 10 influences the magnitude of the current in the primary winding of the transformer. This current must be sufficiently large to cause the magnetron to conduct and to maintain the magnetron filament voltage within operating limits, but subject to these constraints there are advantages in being able to control the magnitude of the impedance 10 in order to control the output power of the magnetron. Hitherto, this has been done by switching in a capacitor of a chosen value, an arrangement having the disadvantages of using costly components and suffering from inflexibility in that only certain power levels dependent on magnitudes of capacitance are available. The use of a resistance of variable magnitude in series with the primary winding of the transformer powering the magnetron opens up the possibility of varying the microwave power delivered in a more economical and progressive way, whilst having the further advantage that the resistive heating produced by the primary current in the series resistor can be utilised to provide (or augment) thermal energy in the convection system.

The theory of this is as follows:

In a conventional microwave cooking appliance where optimum microwave energy is required, the power supply is made up of a single phase half wave doubler with a leakage transformer, the design of which is that both the primary and secondary windings are separated by a magnetic shunt with a high reluctance gap to provide the desired leakage reactance during operation and to saturate the iron core, such that the current within the secondary winding remains fairly constant over relatively wide changes of the primary voltage. To achieve this, the variation of primary current and primary voltage is as shown in FIG. 7 where the operating range is denoted as 26.

When an in-line impedance 10 is in series with the primary winding, the voltage across the primary winding reduces to a value indicated by the region 27 and this allows the transformer to operate on the linear part of its characteristic where the primary current and primary voltage increase substantially linearly.

In the region 27 the resistive primary current is reduced, the inductive primary current remains almost the same, and hence the power factor is reduced (eg from 0.95 to 0.75).

Under these conditions, the primary current is directly proportional to the current flowing through the magnetron. Therefore, by careful selection of the initial impedance 10 and adjustment of the turns ratio of the high voltage transformer 2, it is possible to design a microwave power supply with continuously variable output, as shown schematically in FIG. 8, where 28 represents the variable microwave power output, controllable in dependence upon the adjusted resistive value of the impedance 10. The heat generated within the in-line impedance 10 can:

(1) add to the convection heat source to give a full convection rating in a combination mode (ie simultaneous application of microwave and hot air), (2) remain on continuously during the microwave cycle and independent of the thermostatic convection cycle and in this way continuously heat and crisp the underside of foods (because of the location of the in-line impedance 10 relative to the food within the cavity), (3) provide an inlet heat source to the cavity in a standard microwave oven and, in a refinement, provide for an automatic category selection cooking programme.

As mentioned in relation to FIG. 8, variation of the magnitude of the resistance of the impedance 10 varies the output power of the magnetron, and this variation has been found empirically to be linear. Also, variation in the magnitude of the resistance of the impedance 10 varies the resistive power (ie the hot air power) generated by the primary current flowing through impedance 10. These results can be explained theoretically with reference to FIG. 9 which shows the equivalent circuit or the transformer, ignoring the filament winding 4. The primary impedance 10 is shown as being constituted by a resistance $R_1$ and an impedance $L_1$. M represents the mutual inductance between the transformer windings, and $R_2$ and $X_2$ are respectively the resistance and reactance of the secondary circuit. Calling the input voltage $V_1$ and the primary and secondary currents $I_1$ and $I_2$, the applied primary voltage $V_1$ overcomes the impedance drop in the primary and also overcomes the mutually-induced primary emf due to the current variations in the secondary:

$$V_1=I_1(R_1+j\omega L_1)+j\omega MI_2 \quad (1)$$

where ω is the angular velocity of the alternating supply and is related to its frequency f by the relationship $$\omega=2\pi f$$

The e.m.f. $E_2$ induced in the secondary circuit is $$E_2=-j\omega MI_1$$

and this must supply the total impedance drop in the secondary. Hence, $$-j\omega MI_1=I_2(R_2+j\omega L_2)$$

Therefore $$\frac{I_2}{I_1}=\frac{-j\omega M}{(R_2+j\omega L_2)} \quad (2)$$

Equation (2) shows that the ratio of $I_2$, to $I_1$ is independent of the magnitude of $R_1$. Also, equations (1) and (2) reveal that, if $V_1$ is constant, increasing $R_1$ will decrease both $I_1$ and $I_2$, and decreasing $R_1$ will increase both $I_1$ and $I_2$.

The foregoing explains theoretically why the result shown in FIG. 10 is obtained. FIG. 10 is a graph obtained empirically and shows that the variation between $I_2$ and $I_2$ is linear and that the variation between $I_1$ and the output power produced by the magnetron is linear.

The foregoing analysis assumes that $V_1$ (the input voltage) is approximately constant. In practice $V_1$ may vary and the invention provides a way of stabilising the microwave output power and the hot air power, ie for compensating for variations in input voltage. In a practical embodiment this is done by connecting a voltage sensitive circuit, such as a switch, across the input voltage. The voltage sensitive circuit operates a triac switch, equivalent to switch 12 in FIG. 1 or 4, to switch a part of the primary resistance (ie a part of the resistance of the impedance 10) in or out of circuit. For example, in the USA where the mains voltage is nominally 120 volts, the voltage sensitive circuit would be set to respond to a fall to a predetermined value, such as 110 volts, at which point the triac would be switched so as to reduce $R_1$ and therefore increase both $I_1$ and $I_2$. This would tend to restore both the microwave output power and the hot air power to the respective levels prevailing at an input voltage of 120 volts and thus tend to compensate for the reduction in input voltage. When the input voltage increases to a predetermined value, which could be 120 volts or slightly above or below, the voltage sensitive circuit would cause the triac to restore the full resistance $R_1$ to the circuit.

Reference is now made to FIG. 11 which shows a modification of the oven of FIGS. 1 to 3, the modification compensating for variation in the input voltage $V_1$ applied by the mains supply 7. FIG. 11 is a composite figure, the upper part corresponding to FIG. 1 and the lower part corresponding to FIG. 2. In FIG. 11 parts corresponding to those of FIGS. 1 and 2 bear the same reference numerals.

The oven of FIG. 11 is modified by the incorporation of a triac switch 20 connected to a temperature compensating switch 22 linked to a thermistor 23 attached to the back of the rear wall 13 of the oven cavity, at a location above the resistive heating element 9. The heat output of the element 9 is proportional to the square of the voltage across it, so a reduction in the magnitude of the input voltage $V_1$ will cause a proportionately larger reduction in the heat output of the element 9. The heat output of the impedance 10 is similarly dependant on the magnitude of the input voltage $V_1$. Hence, a reduction in input voltage (eg to 110 volts or below for an oven with a U.S. rating of 120 volts input) will cause a significant reduction in convection heat. The thermistor 23 detects hot air temperature so if the input voltage drops the rate of increase of hot air temperature with time will also decrease.

FIG. 12 shows a representative variation with time of hot air temperature as detected by the thermistor 23. After a predetermined time $t_p$ from switch-on, the slope 24 of the curve of FIG. 12 will be representative of the input voltage $V_1$, a smaller slope being indicative of a smaller input voltage $V_1$. The microprocessor of the oven is programmed to detect the slope 24 of the curve of FIG. 12 at time $t_p$. If the slope 24 is below a certain threshold value (eg corresponding to an input voltage below 110 volts for a normal input of 120 volts), the temperature compensating switch 22 closes the normally open triac switch 20. On closure or the triac switch 20, part of the impedance 10 is shorted out. This has the effect of increasing primary current which tends to restore convection power and microwave power. The triac switch 20 would then typically remain closed for the remainder of that particular cooking operation, being opened to restore the full value of the impedance 10 at the start of the next cooking operation.

FIG. 13 illustrates how compensation for reductions in input voltage $V_1$ can be applied to the oven of FIG. 4. A triac switch 20 is connected across part of the impedance 10. When the triac switch 20 is open, the full impedance 10 is in circuit. When the triac switch 20 is closed, passage omitted by a voltage compensating switch 25 connected across the mains supply 7 so as to be responsive to the input voltage $V_1$. When the input voltage $V_1$ fails below a predetermined value, eg 110 volts for a normal input voltage of 120 volts, this is detected by the switch 25 which closes the triac switch 20 so as to reduce the magnitude of the resistive component of the impedance 10, causing an increase in primary current and an increase in hot air power and microwave power.

I claim:

1. A microwave oven having a cavity to receive food to be cooked, a magnetron for delivering microwave power to the cavity, a transformer having a primary winding powered by an input voltage to the oven and having a secondary winding for supplying a high voltage to the magnetron, wherein an impedance is connected in series with the primary winding, primary current flowing through the impedance producing resistive heating, means for utilizing the resistive heating as hot air power to heat the air in the cavity for cooking of the food, and means for adjusting the magnitude of the impedance so as to vary the magnitude of the primary current, resulting in a continuous stepless variation in the microwave power produced by the magnetron.

2. A microwave oven according to claim 1, wherein said utilizing means comprising a fan for blowing air over the impedance and then into the cavity.

3. A microwave oven according to claim 2, wherein the impendance is positioned adjacent an aperture in a rear wall of the cavity, the fan drawing air from the cavity, through the aperture, over the impendance and then recirculating the heated air into the cavity through apertures in the rear wall of the cavity.

4. A microwave oven according to claim 3, wherein the fan serves to cool the magnetron and wherein the air is heated by being blown over the magnetron and then further heated by being blown over the impendance, before being forced into the oven cavity.

5. A microwave oven according to claim 3, wherein the oven has a temperature sensing device for sensing the temperature of the air and the temperature sensing device is located in the region where the air leaves the oven cavity.

6. A microwave oven according to claim 1, wherein the oven has in addition to the impendance, a main resistive heating element over which air is drawn, the resistive heating produced by the air over the impendance supplementing the heating produced by the air forced over the main heating element.

7. A microwave oven according to claim 1, and including voltage sensitive means responsive to the magnitude of the input voltage to the microwave oven, the voltage sensitive means responding to variations in the magnitude of the input voltage by reducing the magnitude of the impedance on a reduction in the magnitude of the input voltage, so as to compensate the microwave power produced by the magnetron for variations in the input voltage.

8. A microwave oven according to claim 7, wherein the voltage sensitive means also compensates the hot air power for variations in the input voltage.

* * * * *